US005912642A

United States Patent [19]

Coffin et al.

[11] Patent Number: 5,912,642

[45] Date of Patent: Jun. 15, 1999

[54] METHOD AND SYSTEM FOR ALIGNING A SENSOR ON A PLATFORM

[75] Inventors: John Coffin, Denver; James B. Mohl, Louisville, both of Colo.

[73] Assignee: Ball Aerospace & Technologies Corp., Broomfield, Colo.

[21] Appl. No.: 09/067,210

[22] Filed: Apr. 28, 1998

[51] Int. Cl.[6] ..... H01Q 3/00

[52] U.S. Cl. ..... 342/359

[58] Field of Search ..... 342/359

[56] References Cited

U.S. PATENT DOCUMENTS

| | | | |
|---|---|---|---|
| 4,358,767 | 11/1982 | Boireau | 343/117 R |
| 4,418,350 | 11/1983 | Rosen | 343/359 |
| 4,599,619 | 7/1986 | Keigler et al. | 343/352 |
| 4,630,058 | 12/1986 | Brown | 342/359 |
| 4,853,839 | 8/1989 | Nichols et al. | 364/167.01 |
| 4,888,592 | 12/1989 | Paik et al. | 342/359 |
| 4,910,524 | 3/1990 | Young et al. | 342/354 |
| 4,963,890 | 10/1990 | Perrotta et al. | 342/359 |
| 4,970,520 | 11/1990 | Khaletzki et al. | 342/359 |
| 5,043,737 | 8/1991 | Dell-Imagine | 342/358 |
| 5,258,764 | 11/1993 | Malinowski | 342/359 |
| 5,347,286 | 9/1994 | Babitch | 342/359 |
| 5,359,337 | 10/1994 | Eguchi | 343/765 |
| 5,398,035 | 3/1995 | Densmore et al. | 343/713 |
| 5,455,592 | 10/1995 | Huddle | 342/359 |
| 5,463,401 | 10/1995 | Iwasaki | 342/359 |
| 5,463,402 | 10/1995 | Walrath et al. | 342/359 |
| 5,583,514 | 12/1996 | Fulop | 342/359 |
| 5,592,176 | 1/1997 | Vickers et al. | 342/359 |
| 5,629,709 | 5/1997 | Yamashita | 342/359 |

*Primary Examiner*—Theodore M. Blum
*Attorney, Agent, or Firm*—Sheridan Ross P.C.

[57] ABSTRACT

Desired positioning of a sensor, such as an antenna, is provided. The system includes a platform which can be a vehicle, such as an aircraft. The sensor is connected to the platform by means of a mount. Alignment data is obtained in order to compensate for any difference in reference coordinate systems between the platform and the mount when the platform is in a first position. The alignment data can be obtained by incremental scanning of the sensor relative to an object that transmits a signal to the sensor. The strengths or amplitudes of the signals at the incremental positions can be utilized in calculating or arriving at the alignment data used to compensate for any misalignments between the coordinate systems of the platform and the mount. When the movable platform is in another position, the alignment data is used to desirably position the sensor.

18 Claims, 7 Drawing Sheets

344

DETERMINE THE MATRIX, $C_{SP}$, OF THE TRANSFORMATION FOR TRANSFORMING THE PLATFORM COORDINATE SYSTEM 32 INTO THE SENSOR COORDINATE SYSTEM 48 WHEREIN:

(A) THE $X_S$ AXIS OF THE COORDINATE SYSTEM 48 IS DIRECTED TO POINT IN THE DIRECTION OF A COMMANDED AZIMUTH ($\alpha_C$) AND ELEVATION ($\delta_C$), AND (B) IT IS ASSUMED THAT THE PLATFORM 20 AND THE MOUNT 24 ARE EXACTLY ALIGNED (I.E., THE COORDINATE SYSTEMS 32 AND 36 ARE IDENTICAL).

ACCORDINGLY, $$C_{SP} = \begin{bmatrix} \cos\delta_C\cos\alpha_C & \cos\delta_C\sin\alpha_C & -\sin\delta_C \\ -\sin\alpha_C & \cos\alpha_C & 0 \\ \sin\delta_C\cos\alpha_C & \sin\delta_C\sin\alpha_C & \cos\delta_C \end{bmatrix}$$

348

DETERMINE THE MATRIX, $C_{SM}$, FOR TRANSFORMING A SENSOR 40 POINTING DIRECTION (E.G., OBTAINED FROM A TRANSFORMATION ASSUMING ALIGNMENT OF THE PLATFORM 20 AND THE MOUNT 24) INTO THE MOUNT 24 COORDINATE SYSTEM 36 (NOT ASSUMING ALIGNMENT), WHEREIN $C_{MS}$ IS IN TERMS OF ($\alpha_{new}$, $\delta_{new}$). ACCORDINGLY:

$$C_{SM} = \begin{bmatrix} \cos(\delta_{new})\cos(\alpha_{new}) & \cos(\delta_{new})\sin(\alpha_{new}) & -\sin(\delta_{new}) \\ -\sin(\alpha_{new}) & \cos(\alpha_{new}) & 0 \\ \sin(\delta_{new})\cos(\alpha_{new}) & \sin(\delta_{new})\sin(\alpha_{new}) & \cos(\delta_{new}) \end{bmatrix}$$

352

DETERMINE THE ENTRIES OF THE MATRIX, $C_{MP}$, FOR TRANSFORMING PLATFORM COORDINATES TO MOUNT COORDINATES AS FOLLOWS: $C_{MP} \leftarrow (C_{SM})^T C_{SP}$

356

RETURN ($C_{MP}$)

FIG. 3C

METHOD AND SYSTEM FOR ALIGNING A SENSOR ON A PLATFORM

FIELD OF THE INVENTION

The present invention relates to controlling the orientation of a sensor on a movable platform and, in particular, determining a desired orientation of the sensor where a mount attaches the sensor to the platform

BACKGROUND OF THE INVENTION

When mounting a signal sensor assembly on a movable platform such as an aircraft for thereby detecting transmissions from, e.g., satellites or ground-based objects, it has heretofore been necessary to physically align the sensor assembly with high precision to a reference coordinate system for the platform. That is, since commands to orient the sensor are likely to be from the platform coordinate system frame of reference, any misalignment of the sensor assembly will cause the sensor of the sensor assembly to point in a different direction from what was intended. Moreover, since the sensor assembly typically includes in addition to the sensor (e.g. antenna), a sensor mount upon which both the sensor and one or more sensor orienting actuators are provided, wherein the actuators orient the sensor according to a reference coordinate system associated with the mounts Accordingly, the alignment of the mount reference coordinate system with the platform reference coordinate system has been a time-consuming and labor-intensive process. The process has heretofore required that technicians iteratively position the sensor assembly on the platform, take measurements to determine whether the mount and the platform coordinate systems are sufficiently aligned, and if not, then at least loosen the mount from the platform and adjust its orientation with respect to the platform, or provide shims between the mount and the platform.

Accordingly, it would be very advantageous to be able to secure the sensor assembly to the platform substantially without concern for aligning the mount and platform coordinate systems, and determine a misalignment compensation coordinate system transformation that can subsequently be utilized for accurately pointing the sensor in substantially any desired direction.

SUMMARY OF THE INVENTION

The present invention is a novel method and system of accurately pointing a sensor or antenna in a requested direction, wherein the present invention compensates for misalignments between a platform for the sensor, and a sensor mount, the mount used both as a support for the sensor and as the component for attaching the sensor to the platform. Thus, the sensor alignment system of the present invention allows a sensor to be attached to a platform such as an aircraft without the time consuming and exacting procedures of providing a high precision alignment between the mount and the platform heretofore required for aligning a coordinate system relative to, e.g., the platform with a coordinate system relative to the mount.

Accordingly, the present invention compensates for a misalignment between the platform and the mount by measuring the misalignments through an iterative process, and subsequently using the measurements in a misalignment compensating process. In particular, by orienting the sensor to point to a signal transmitting beacon wherein the locations of both the platform and the beacon are quantitatively known, measurements related to the (any) misalignment between the platform and the mount can be determined. Moreover, once such measurements are obtained, these measurements can be used in a misalignment compensating process for orienting the sensor to accurately point in substantially any desired direction when provided with corresponding sensor orientation data relative to the platform coordinate system.

In one embodiment for determining misalignment measurements a platform such as an aircraft can be stationed at a known location (e.g., in inertial coordinates having an origin at the center of the earth), and an adaptive scanning procedure can be initiated so that the sensor scans for an optimal signal strength transmitted from the beacon whose location is also known (in, e.g., inertial coordinates). Accordingly, by having the sensor "home-in" on the maximal signal strength of signals transmitted from the beacon, misalignment offsets such as azimuth and elevation offsets between the coordinate system relative to the platform and the coordinate system relative to the mount can be determined.

Moreover, it is an aspect of the present invention that once such misalignment offset data is obtained, this data can be used in a procedure for accurately pointing the sensor in substantially any direction. That is, pointing commands provided in terms of, e.g., a platform coordinate system, can be reliably and accurately transformed into corresponding sensor movement commands (in, e.g., gimbal coordinates) for pointing the sensor in the commanded direction. Additionally, note that such accurate pointing of the sensor can occur while the platform is in motion relative to the beacon. In particular, if the platform is an aircraft and the beacon is a satellite, as long as the locations of the aircraft and the beacon are known, e.g., in inertial coordinates, then the present invention can be used to accurately direct the sensor to point toward the satellite. Accordingly, in providing this capability, the present invention may provide transformations between a number of coordinate systems for transforming pointing vectors between, for example, the inertial coordinate system to the coordinate system of the sensor. In particulars transformations for the following intermediary coordinate systems may be used (either explicitly or implicitly):

(a) a local coordinate system that can be conceptualized as located with its origin on the surface of the earth immediately under the platform with its X and Y axes aligned with latitude and longitude lines such that the Z axis points toward the center of the earth according to the right hand rule;

(b) a platform coordinate system that is relative to an orientation of the platform; accordingly, if the platform is an aircraft, then various orientations of such a platform coordinate system may be attained during flight depending upon the heading, pitch and roll of the aircraft as one skilled in the art will understand;

(c) a mounting coordinate system, as discussed hereinabove, that has its axes positioned according to an orientation of the sensor mount.

Accordingly, the present invention may be used for positioning an antenna for optimal data transmission to/from a satellite. Moreover, the present invention may be used for determining the coordinates of a detected signal source, wherein the sensor "homes-in" on a signal source, such as on the earth's surface, and a direction vector is subsequently determined indicative of the optimal signal strength from the signal source. Thus, the present invention provides a reliable and accurate process for translating the direction vector along which the sensor is pointing into platform coordinates, and subsequently into inertial coordinates so that when the transformed direction vector is positioned so as to point from the inertial coordinates of the platform, then the intersection of this direction vector with the surface of the earth is indicative of the location of the signal source.

Other aspects and features of the present invention will be disclosed in the detailed description and the accompanying drawings provided herein.

BRIEF DESCRIPTION OF THE DRAWINGS

FIGS. 3A, 3B and 3C describe a flowchart for the steps performed in determining measurements of misalignment errors between the platform 20 and the mount 24.

DETAILED DESCRIPTION

Figure 1:
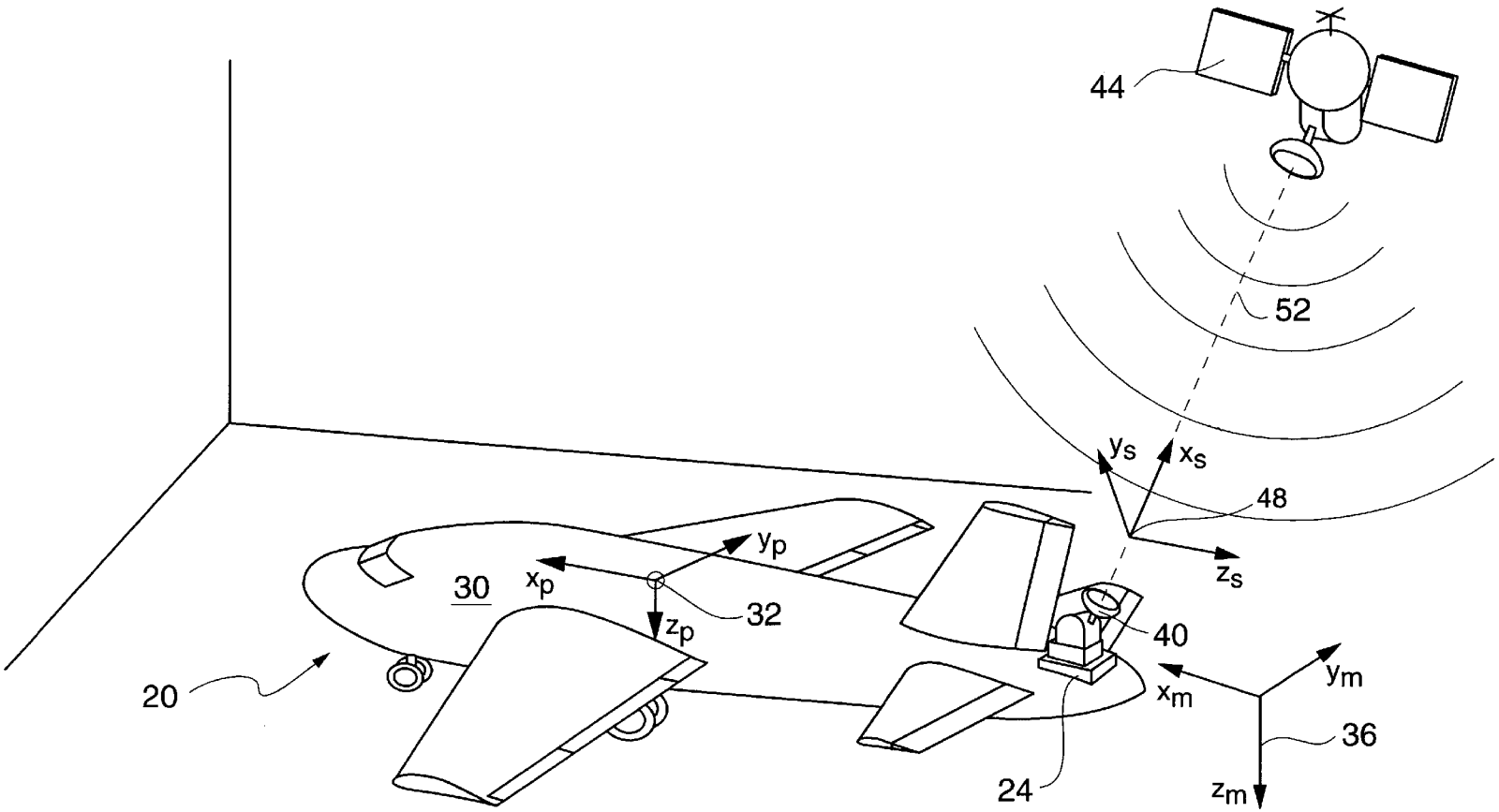
FIG. 1 is an illustration of the positioning of a platform (i.e., aircraft) 20 provided in a quantitatively known coordinate position, wherein the misalignment errors between the platform and a sensor mount 24 are quantitatively measured.

FIG. 1 shows an illustration of the positioning of the platform 20 (represented as an aircraft) for determining measurements related to alignment errors between the platform 20 and a sensor mount 24, upon which a sensor 40 is provided. In particular, the present invention uses the resulting alignment error measurements in a process that compensates for the alignment errors so that the sensor 40 can be accurately pointed in substantially any desired direction when direction commands are input relative to a platform coordinate system 32, discussed hereinbelow. Accordingly, in the present figure, the aircraft 20 is positioned at a known location on the ground, and the aircraft has the sensor mount 24 and the sensor 40 attached thereto. The alignment errors between the aircraft 20 and the mount 24 are visually shown in FIG. 1 as a change in the orientations between the coordinate system 32 for the aircraft 20, and the coordinate system 36 for the mount 24. Note that this is different from prior art techniques for attaching the mount 24 to the platform 20 in that in such prior art techniques, the coordinate system 36 for the mount 24 is aligned with high precision to the coordinate system 32 for the aircraft 20. However, for the present invention, this need not be the case.

There are three coordinate systems shown in FIG. 1 that are important to understand: the platform and mounting coordinate systems 32 and 36 mentioned above as well as a coordinate system 48 for the sensor 40. Regarding the platform coordinate system 32, it is typically aligned so that: (a) the $X_P$ axis is coincident with the longitudinal axis of the fuselage 30, i.e., generally, this axis is aligned with the direction of flight of the aircraft 20, (b) the $Z_P$ axis points in a direction both normal to the $X_P$ axis and through the bottom center of the fuselage 30. Moreover, since the coordinate system is oriented according to the right-hand rule, the $Y_P$ axis is directed perpendicularly to the other two axes and through the right wing (with respect to an individual facing in the direction of the $X_P$ axis). The (mount) coordinate system 36 for the mount 24 is potentially a skewed form of the coordinate system 32. That is, at least one of the following conditions may occur:

(1.1) $X_M$ is not in alignment with $X_P$;

(1.2) $Y_M$ is not in alignment with $Y_P$; and (1.3) $Z_M$ is not in alignment with $Z_P$.

Additionally, the (sensor) coordinate system 48 is typically oriented so that the direction of the sensor 40 points is coincident with the $X_S$ axis and the other two axes $Y_S$ and $Z_S$ are normal thereto and to each other according to the right-hand rule.

Thus, for the sensor 40 to be accurately directed from the aircraft 20 coordinate system 32 so that the sensor can point in a requested direction, the present invention solves a compensating matrix equation using, e.g., a matrix transformation between the platform and mounting coordinate systems 32, 36 to account for misalignments of the mount 24 onto the aircraft 20.

To determine the alignment error measurements, the sensor 40 is first directed to point in the approximate direction of a beacon, which in FIG. 1 is a satellite 44, of known position. In particular, the sensor 40 is shown as pointing approximately in the direction of axis 52 and therefore, the $X_S$ axis of the sensor's coordinate system 48 is approximately aligned with the axis 52, but may not be pointing in exactly a direction for optimally receiving transmissions from the satellite 44 due to the above-mentioned mounting errors between the mount 24 and the aircraft 20.

That is, there may be an unknown coordinate relationship between the two coordinate systems 32 and 36.

Figure 3A:
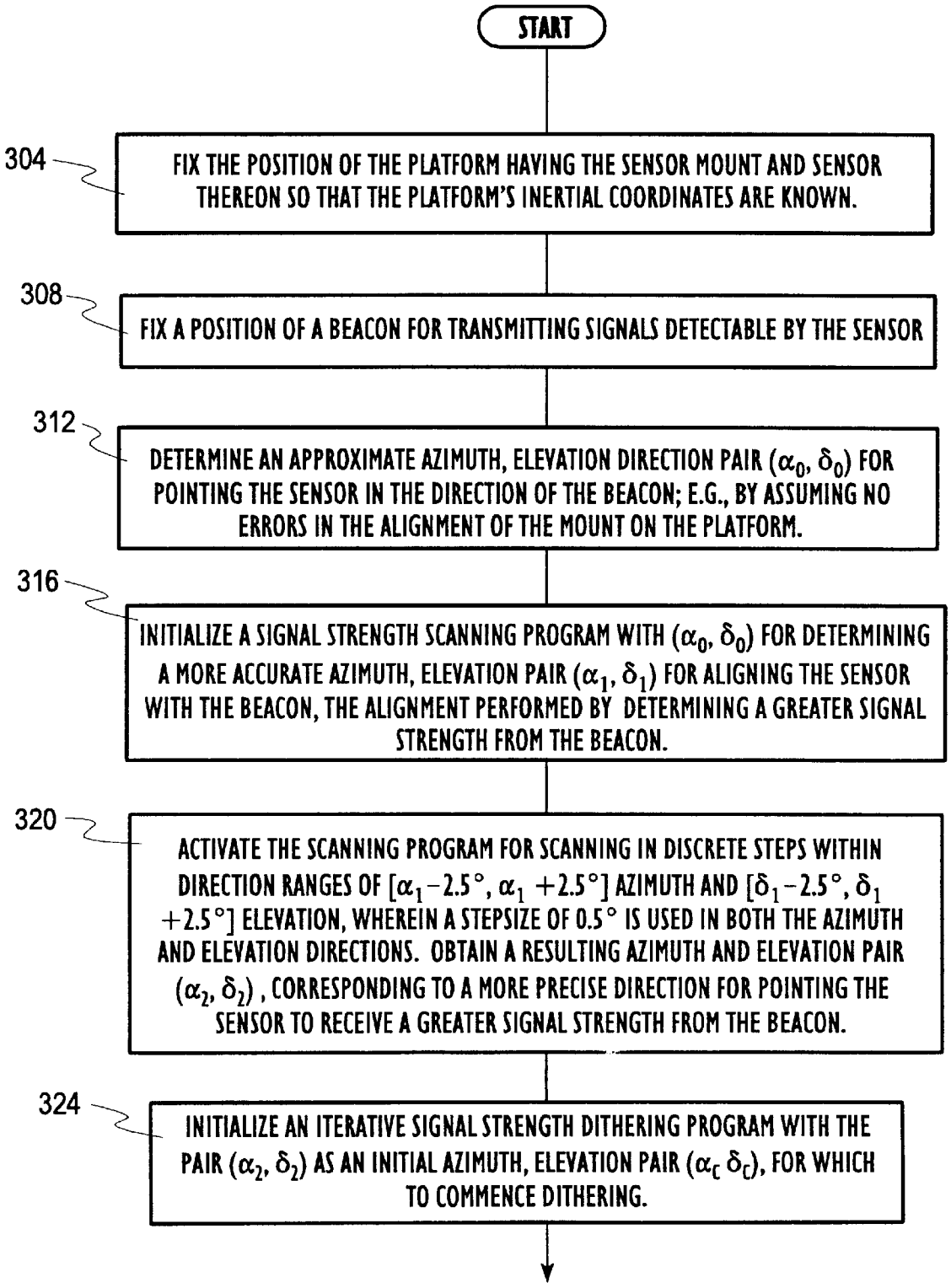
Figure 3B:
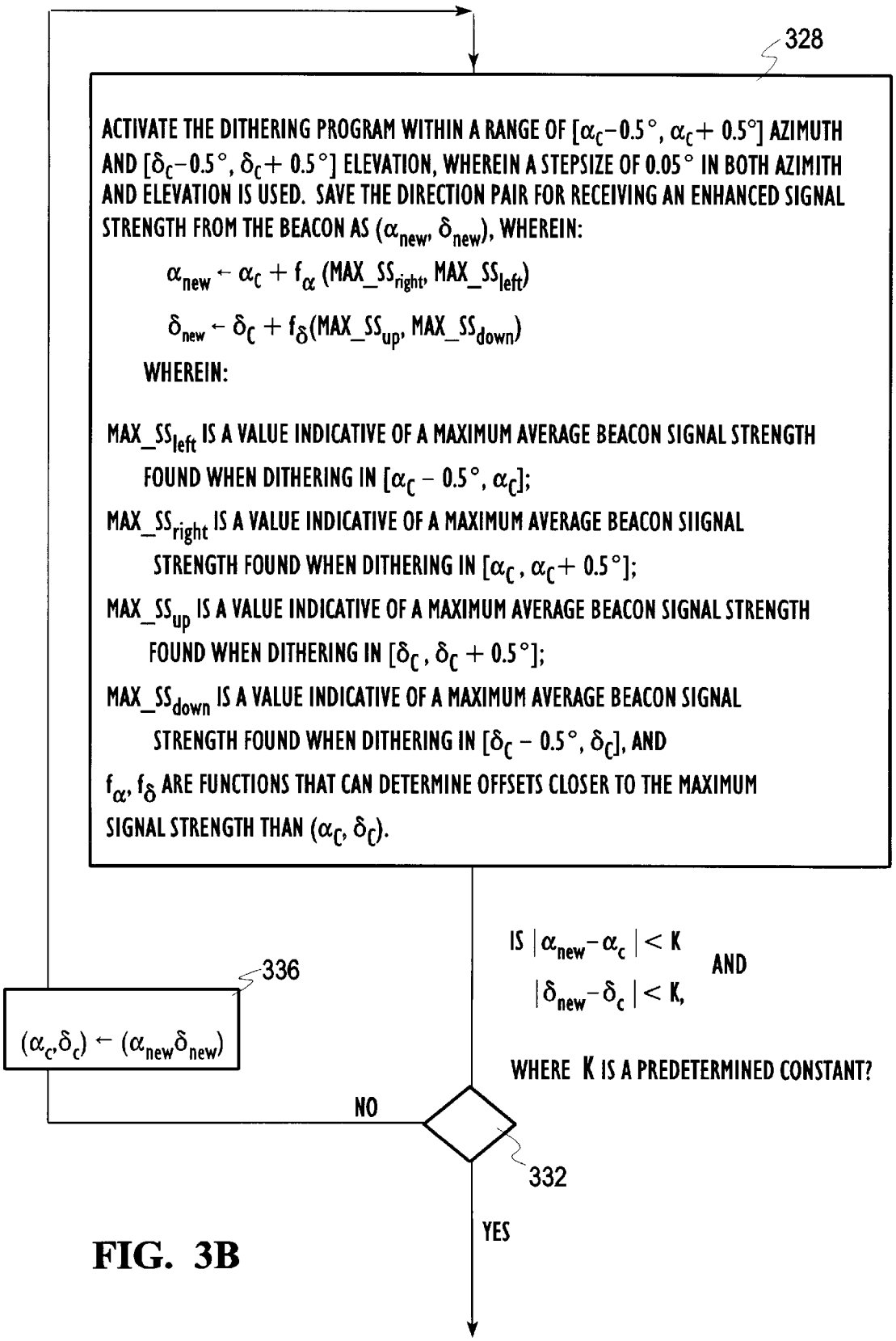

Accordingly, once the sensor 40 is pointing approximately at the satellite 44, to determine the alignment error measurements or misalignments between the coordinate systems 32 and 36, the steps set out generally in the flow chart of FIGS. 3A, 3B and 3C is performed. In particular, the performed steps determine misalignment measurements indicative of misalignments in a vertical orientation of the sensor 40 (e.g. where the vertical axis is defined according to the $Z_M$ axis of the coordinate system 36), and in a horizontal orientation (e.g. according to a rotation of the sensor 40 in a plane parallel to the plane defined by $X_M$ and $Y_M$ axes of the coordinate system 36). Note that the horizontal orientation is herein denoted as "azimuth" and the vertical orientation of the sensor 40 is herein denoted as "elevation" and changes in these two values induced by misalignments are, respectively, denoted as $\Delta\alpha$ and $\Delta\delta$. Thus, in FIGS. 3A, 3B and 3C, $\Delta\alpha$ and $\Delta\delta$ are determined by reorienting the sensor 40 from an initial position wherein the sensor should be pointing at the satellite, to a second position wherein the sensor is actually pointing at the satellite. In particular, this reorienting is performing by an iterative procedure that directs the sensor 40 to point in a direction for optimal signal strength from the satellite 44.

Given the above discussion, the steps of the flowchart for FIGS. 3A, 3B and 3C can now be described. Thus, in step 304, the position of the aircraft 20 (or platform) having the sensor mount 24 and sensor 40 is provided in a position wherein the aircraft's inertial coordinates (i.e. coordinates with respect to a predefined coordinate system having its origin at the center of the earth) are known. Subsequently, in step 308, the position of the satellite 44 (also denoted a beacon) that transmits signals detectable by the sensor 40 is determined in, e.g., inertial coordinates. In step 312, an approximate azimuth and elevation direction pair ($\alpha_0$, $\delta_0$) is determined for pointing the sensor 40 in the direction of the beacon 44 assuming no errors in the alignment of the mount 24 on the platform 20. In one embodiment, this is performed by determining the inertial coordinates of the beacon 44 and subtracting therefrom the inertial coordinates of the platform 20, and subsequently translating this resulting difference vector into the aircraft coordinate system 32, and then into the sensor coordinate system 48 (assuming no misalignment between the coordinate systems 32 and 36). Subsequently, in step 316, a signal strength scanning program is initialized with the pair ($\alpha_0$, $\delta_0$) for determining a more accurate azimuth and elevation pair ($\alpha_1$, $\delta_1$) that better aligns the sensor 40 with the beacon 44 as determined according to signal strength measurements of signals from the beacon. Then, in step 320, the scanning program determines an azimuth and elevation range of 5° about the direction determined by ($\alpha_1$, $\delta_1$) and scans within this two-dimensional range for the strongest signal strength detected. More precisely, the scanning program causes the sensor 40 to scan in the azimuth direction in discrete step sizes of 0.5° through the 5° range about $\alpha_1$) thereby sampling the beacon 44 signal strength at ten discrete sampling positions in addition to the position corresponding to $\alpha_1$. Moreover, at each such position, ten signal strength samples are taken and an average or composite signal strength from the position is determined. Subsequently, the maximum composite signal strength from each of the eleven sample azimuth positions is determined and the azimuth position corresponding to the maximum composite signal strength is the azimuth coordinate result $\alpha_2$ from the scanning program. Similarly, a scanning is performed in the elevation direction about the elevation $\delta_1$ so that eleven discrete composite elevation signal strength samples are obtained. That is, starting with 67 $_1$−2.5°, as the first elevation positions a collection of ten samples of beacon 44 signal strength is measured and then averaged. Subsequently, the elevation position of the sensor 40 is iteratively incremented by 0.5° to obtain ten additional elevation positions from which beacon 44 composite signal strengths are determined. Thus, a resulting elevation $\delta_2$ is determined as the elevation corresponding to a maximum composite average signal strength.

Subsequently, in step 324, an iterative signal strength dithering program is initialized for determining a still finer accuracy for the azimuth and elevation where a maximum signal strength is detected from the beacon 44. In particular, the pair ($\alpha_2$, $\delta_2$) obtained from step 320 is now provided as an initialization for the azimuth and elevation pair ($\alpha_C$, $\delta_C$) which is used in subsequent steps as the pair corresponding to a sensor direction for the strongest signal strength thus far encountered from the beacon 44. In particular, $\alpha_C$ is assigned a value of $\alpha_2$, and $\delta_C$ is assigned the value of $\delta_2$.

In step 328, the dithering program is performed for generating a new azimuth, elevation pair ($\alpha_{new}$, $\delta_{new}$). In particular, the dithering program dithers within a range of [$\alpha_C$−0.5°, $\alpha_C$+0.5°] in the azimuth direction and [$\delta_C$−0.5°, $\delta_C$+0.5°] in the elevation direction. Moreover, the dithering is performed in each of four directions from the initial direction indicated by pair ($\alpha_C$, $\delta_C$); i.e. (a) in the range [$\alpha_C$−0.5°, $\alpha_C$], hereinafter also denoted as the "left range", (b) in the range [$\alpha_C$, $\alpha_C$+0.5°] hereinafter also denoted as the "right range", (c) in the range of [$\delta_C$−0.5°, $\delta_C$] hereinafter also denoted as the "down range", and (d) in the range [$\delta_C$,$\delta_C$+0.5°], hereinafter also denoted as the "up range". Accordingly, for each one of the left, right, up, down ranges, the dithering program incrementally samples the signal strength from the beacon 44 at step sizes of 0.05°. Thus, each such range potentially has a corresponding total of six positions (including ($\alpha_C$, $\delta_C$) as a common value corresponding with each of the ranges). Further, at each discrete sampling position of the sensor 40, for each of the ranges ten signal strength sample measurements are obtained and averaged to thereby obtain a average signal strength per discrete sensor 40 position. Accordingly, a maximum composite average signal strength is determined for each of the four ranges; i.e. the maximum of each of the six resulting signal strength measurements obtained from each of the ranges is determined. These maximum values are denoted as:

(a) $MAX_SS_{left}$ is the maximum signal strength measurement in the left range;

(b) $MAX_SS_{right}$ is the maximum signal strength measurement in the right range;

(c) $MAX_SS_{down}$ is the maximum signal strength measurement in the down range;

(d) $MAX_SS_{Up}$ is the maximum signal strength measurement for the up range.

Subsequently, once these maximum measurements have been determined, functions $f_\alpha$ and $f_\delta$ are used to determine, respectively, the azimuth and elevation offsets from the current azimuth and ($\alpha_C$), and elevation ($\delta_C$). In particular, $MAX_SS_{right}$ and $MAX_SS_{left}$ become arguments for $f_\alpha$, and $MAX_SS_{Up}$ and $MAX_SS_{down}$ become arguments for the function $f_\delta$. Note that it is an aspect of the present invention that the functions $f_\alpha$ and $f_\delta$ can be defined as follows:

$$f_\alpha(\mathrm{MAX_SS_{right}}, \mathrm{MAX_SS_{left}}) = K * \left[\frac{\mathrm{MAX_SS_{right}} - \mathrm{MAX_SS_{left}}}{\mathrm{MAX_SS_{right}} + \mathrm{MAX_SS_{left}}}\right]$$

$$f_\delta(\mathrm{MAX_SS_{up}}, \mathrm{MAX_SS_{down}}) = K * \left[\frac{\mathrm{MAX_SS_{up}} - \mathrm{MAX_SS_{down}}}{\mathrm{MAX_SS_{up}} + \mathrm{MAX_SS_{down}}}\right]$$

wherein K is a constant, which in one embodiment is 6.9. It is, however, within the scope of the present invention to use other functions that can assist both in transforming measurements of signal strength (in dbm) to an angular offset, and, additionally, generate offsets that tend to change the direction the sensor 40 is pointing so that a stronger signal strength is received from the beacon 44.

Accordingly, the azimuth, elevation pair ($\alpha_{new}$, $\delta_{new}$) has its coordinates defined as follows:

$$\alpha_{new}=\alpha_C+f_\alpha\ (MAX_SS_{right}, MAX_SS_{left})$$

$$\delta_{new}=\delta_C+f_\delta\ (MAX_SS_{up}, MAX_SS_{down})$$

Following step 328, in decision step 332, a determination is made as to whether the difference between $\alpha_{new}$, and $\alpha_C$ is less than a predetermined constant K, and, the difference between $\delta_{new}$ and $\delta_C$ is also less than the constant K for thereby determining whether to perform step 328 again or not. In particular, note that the predetermined constant K may be approximately 0.05.

If the test of step 332 provides a negative result, then step 336 is encountered wherein the newly computed azimuth, elevation pair ($\alpha_{new}$, $\delta_{new}$) becomes the current azimuth elevation pair ($\alpha_C$, $\delta_C$) in preparation for reactivating the step 328. Alternatively, if at step 332 it is determined that the difference between the newly computed azimuth elevation pair and the current azimuth elevation pair is small enough to satisfy the test at this step, then in step 344, a matrix $C_{Sp}$ is determined, wherein this matrix represents the transformation for transforming the platform coordinate system 32 into the sensor coordinate system 48, wherein:

(a) the $X_S$ axis of the sensor coordinate system 48 points in the direction identified by a commanded azimuth orientation ($\alpha_C$) and a commanded elevation orientation ($\delta_C$), and (b) it is assumed that the platform 20 and the mount 24 are exactly aligned so that the coordinate systems 32 and 36 are identical.

Accordingly, $$C_{SP} = \begin{vmatrix} \cos\delta_C\cos\alpha_C & \cos\delta_C\sin\alpha_C & -\sin\delta_C \\ -\sin\alpha_C & \cos\alpha_C & 0 \\ \sin\delta_C\cos\alpha_C & \sin\delta_C\sin\alpha_C & \cos\delta_C \end{vmatrix}$$

In step 348, a matrix $C_{SM}$ is determined for transforming the mounting coordinate system 36 into the sensor coordinate system 48, wherein there is no assumption of alignment between the coordinate systems 32 and 36. Thus, $C_{SM}$ includes an alignment compensating transformation that compensates for any misalignment between the platform coordinate system 32 and the mount coordinate system 36. In particular, the matrix $C_{SM}$ is determined in terms of ($\alpha_{new}$, $\delta_{new}$) determined in the loop of steps 328 through 336. Accordingly, $$C_{SM} = \begin{bmatrix} \cos(\delta_{new})\cos(\alpha_{new}) & \cos(\delta_{new})\sin(\alpha_{new}) & -\sin(\delta_{new}) \\ -\sin(\alpha_{new}) & \cos(\alpha_{new}) & 0 \\ \sin(\delta_{new})\cos(\alpha_{new}) & \sin(\delta_{new})\sin(\alpha_{new}) & \cos(\delta_{new}) \end{bmatrix}$$

as one skilled in the art will understand.

Subsequently, in step 352, a matrix $C_{MP}$ is determined for transforming platform coordinates into mount coordinates (i.e., transforming coordinate system 32 into coordinate system 36), wherein any misalignments between the mount 24 and the platform 20 are taken into account. In particular, the matrix $C_{MP}$ is determined using the matrices $C_{SM}$ and $C_{SP}$ as follows. Since $C_{SM}$ compensates for any misalignment transformation in $C_{SP}$, the following holds:

$$C_{SM}\, C_{MP} = C_{SP}$$

Accordingly, the following is obtained:

$$C_{MP} = (C_{SM})^{-1}\, C_{SP} = (C_{SM})^{T} C_{SP}$$

Subsequently, in step 356, the matrix $C_{MP}$ is returned.

Figure 4A:
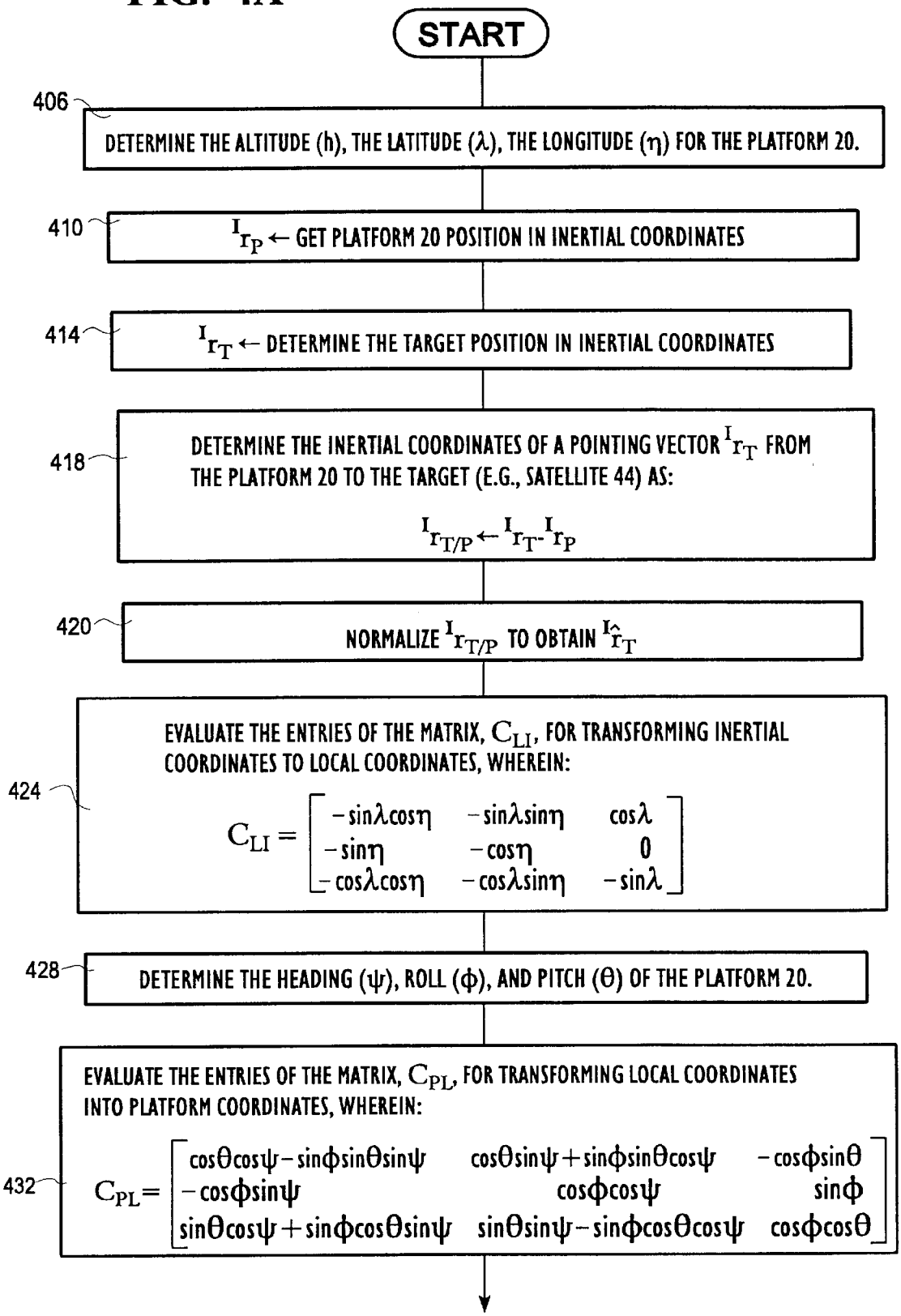
FIGS. 4A and 4B provide the steps of a flowchart for transforming sensor azimuth and elevation orientation commands, with respect to the platform coordinate system 32, into corresponding azimuth and elevation commands that are corrected for any misalignments between the platform 20 and the sensor mount 24.
Figure 4B:
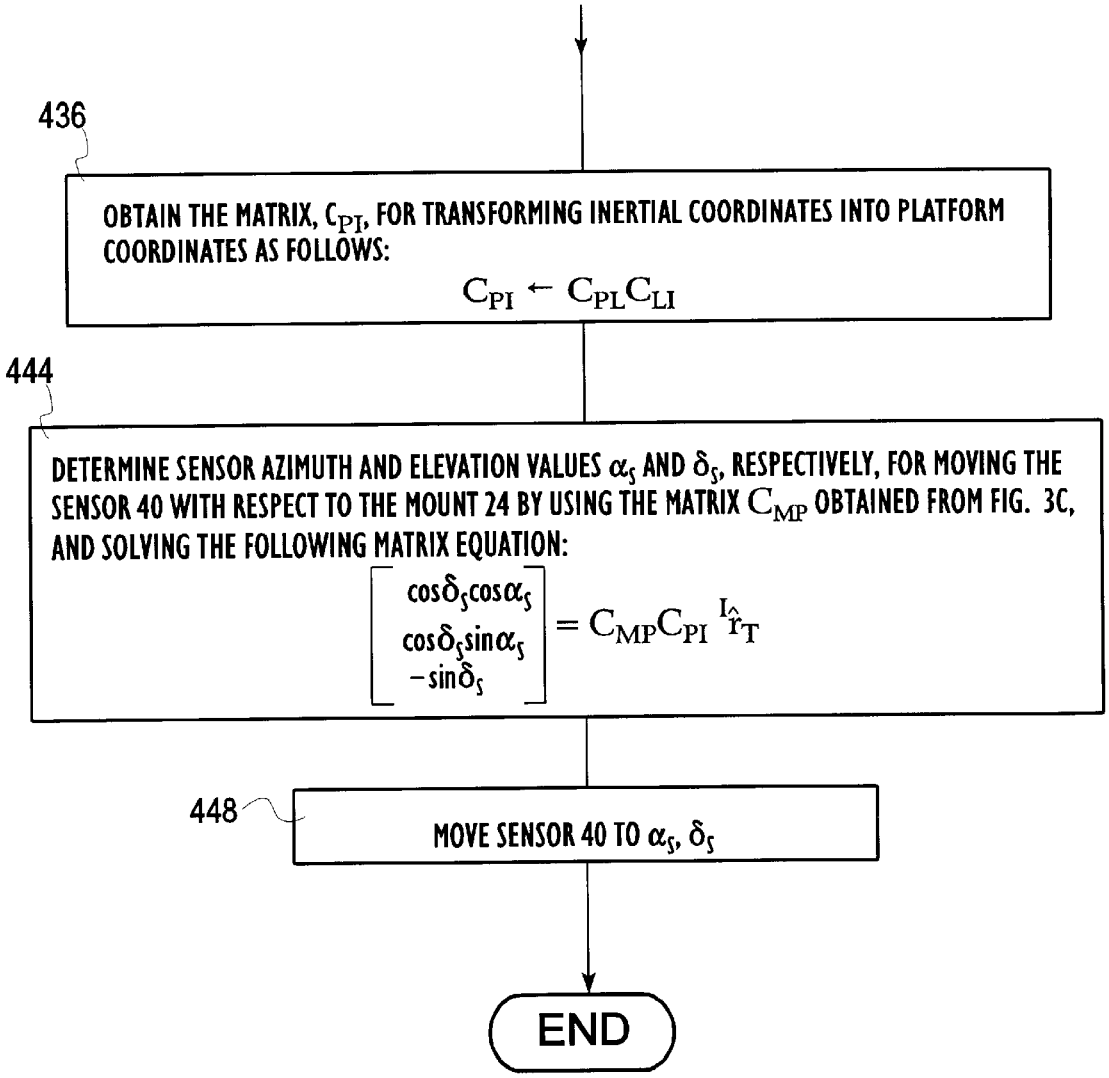

Prior to discussing the computations of the steps of FIGS. 4A and 4B for directing the sensor 40 to point in a desired direction regardless of any misalignments between the platform 20 and the mount 24, it is worthwhile to describe at a high level the transformations used in causing the sensor 40 to point in a desired direction. Thus, referring to FIG. 2, when the aircraft 20 is airborne, and it is desired to point the sensor 40 in the direction of a target (such as the satellite 44), a vector 52 corresponding to the desired direction to point the sensor 40 may be easily obtained in inertial coordinates by determining the inertial position vector 54 for the satellite 44 and the inertial position vector 58 for the platform 20 (shown in FIG. 2 as pointing to the sensor 40; however, for the magnitude of the position vectors 54 and 58, the location upon the platform 20 to which the position vector 58 points does not affect the pointing of the sensor 40 toward the satellite 44 sufficiently to be of concern). Thus, upon obtaining the values for the position vectors 54 and 58 the vector 52 can be computed in inertial coordinates, and accordingly an inertial coordinate direction vector in the direction of position vector 52 can be obtained.

In order to provide actuating controls for moving the sensor 40 so that it points along the vector 52 the vector 52 is transformed from inertial coordinates into a vector, v, in the sensor coordinate system 48. Subsequently, sensor 40 actuators move the sensor so that the sensor coordinate system 48 reorients to align the axis $X_S$ with the vector 52 (equivalently, the elements of the vector v approach the values [1,0,0]). To perform such transformations of vector 52 (and/or a direction vector coincident with vector 52), the direction vector 52 is first transformed into the local coordinate system 62 that can be considered as having its origin on the earth's surface directly below the platform 20 and its axis $X_L$ and $Y_L$ aligned along latitudinal and longitudinal directions so that the vertical dimension $Z_L$ points to the center of the earth when the right hand rule is used. Subsequently, after providing the vector 52 in the local coordinate system 62, the vector 52 is then transformed into the platform coordinate system 32. Note that the orientation of the platform coordinate system 32 depends upon the heading, roll and pitch of the platform 20 as one skilled in the art will understand. After having provided the vector 52 in platform coordinates according to coordinate system 32, the vector 52 must then be transformed into the mount coordinate system 36 which may be somewhat misaligned from the coordinate system 32, and accordingly, the present invention is directed to providing a transformation between the coordinate system 32 and 36 so that the vector 52 can be translated into the coordinate system 36 of the mount 24. Thus, once the vector 52 is translated into the coordinate system 36, actuators then can be used to align the $X_S$ axis of the sensor coordinate system 48 with the vector 52.

Figure 2:
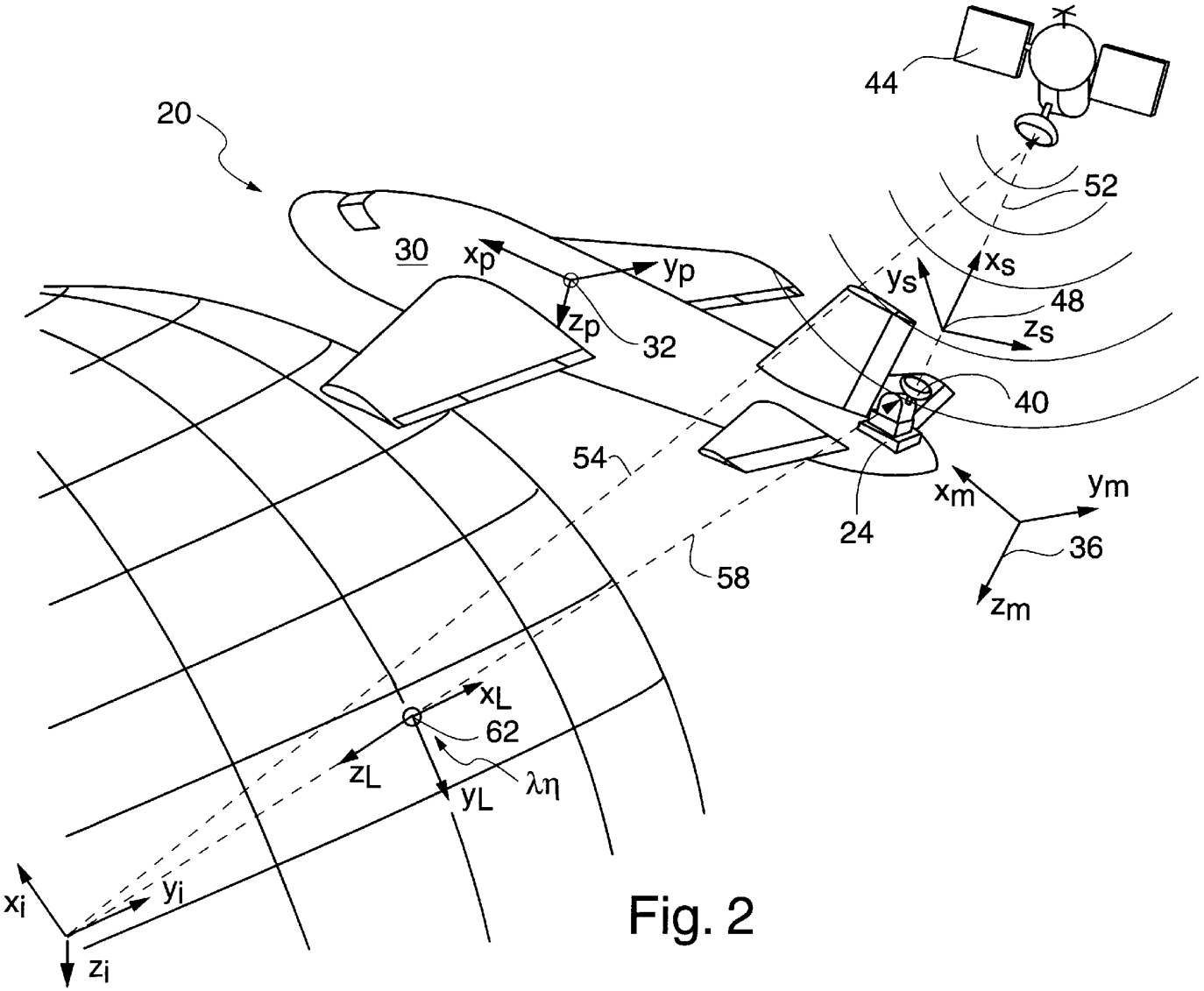
FIG. 2 illustrates the vectors and coordinate systems used in transforming directional sensor commands provided in, for example, the platform 20 coordinate system 32 into corresponding commands that point the sensor 40 in the desired direction regardless of any misalignments between the coordinate system 32 for the platform and the coordinate system 36 for the mount 24.

Referring now to FIGS. 4A and 4B, a flow chart is presented of the steps performed, at least conceptually, for moving the sensor 40 for pointing in a manner which compensates for any misalignments between the platform 20 and the mount 24. Accordingly, in step 406, the altitude (h), latitude ($\lambda$) and longitude ($\eta$) for the platform 20 is determined. Subsequently, in step 410, the position of the platform 20 in inertial coordinates is determined and assigned to the variable ${}^{I}r_P$. Note that the position that vector 58 of FIG. 2 represents is the value ${}^{I}r_P$ (wherein the magnitude of ${}^{I}r_P$=h). In step 414, the position of a target signal source to which to direct the sensor 40 to point is determined in inertial coordinates, and assigned to the variable ${}^{I}r_T$. Note that ${}^{I}r_T$ corresponds to the position vector 54 in FIG. 2 assuming that the target is satellite 44. Following step 414, in step 418, a pointing vector ${}^{I}r_{T/P}$ is determined for providing the direction of the target (e.g., satellite 44) from the platform 20 in inertial coordinates. Accordingly, ${}^{I}r_{T/P}$ is determined as ${}^{I}r_T - {}^{I}r_P$. Note in step 420 that ${}^{I}r_T$ is normalized, obtaining ${}^{I}\hat{r}_T$, i.e., $${}^{I}\hat{r}_T = \frac{{}^{I}r_T}{\text{magnitude}({}^{I}r_T)}.$$

Further note that the pointing vector 52 of FIG. 2 is ${}^{I}\hat{r}_T$, again assuming that the satellite 44 is the target.

Subsequently, in step 424, a matrix $C_{LI}$ is determined for transforming from the inertial coordinate system into the local coordinate system 62, wherein the coordinate system 62 can be considered as a local coordinate system for the platform 20 wherein its origin is on the surface of the earth immediately below the platform 20 as discussed hereinabove. Note that the origin of the local axis 62 is ($\lambda$, $\eta$) as shown in FIG. 2. Accordingly, as one skilled in the art will appreciate, the matrix $C_{LI}$ is defined as:

$$C_{LI} = \begin{bmatrix} -\sin\lambda\cos\eta & -\sin\lambda\sin\eta & \cos\lambda \\ -\sin\eta & -\cos\eta & 0 \\ -\cos\lambda\cos\eta & -\cos\lambda\sin\eta & -\sin\lambda \end{bmatrix}$$

In step 428, the heading ($\psi$), roll ($\phi$), and pitch ($\theta$) of the platform 20 are determined. Following this, in step 432, a matrix $C_{PL}$ is determined for transforming from the local coordinate system 62 (FIG. 2) into the coordinate system 32 of the platform 20 using the heading, roll and pitch parameters determined in step 428 above. Accordingly, the matrix $C_{PL}$ can be defined as:

$$C_{PL} = \begin{bmatrix} \cos\theta\cos\psi - \sin\phi\sin\theta\sin\psi & \cos\theta\sin\psi + \sin\phi\sin\theta\cos\psi & -\cos\phi\sin\theta \\ -\cos\phi\sin\psi & \cos\phi\cos\psi & \sin\phi \\ \sin\theta\cos\psi + \sin\phi\cos\theta\sin\psi & \sin\theta\sin\psi - \sin\phi\cos\theta\cos\psi & \cos\phi\cos\theta \end{bmatrix}$$

as one skilled in the art will understand.

Subsequently, in step 436, a matrix $C_{PI}$ can be determined for transforming from inertial coordinates into platform coordinates of the coordinate system 32 via the following matrix multiplication formula:

$$C_{PI}=C_{PL}C_{LI}$$

Before proceeding to step 444 of FIG. 4B, some further background information is worthwhile. Let the azimuth and elevation pair ($\alpha_S$, $\delta_S$) be considered as offsets from the mount coordinate system 36, wherein the azimuth ($\alpha_S$) and elevation ($\delta_S$) are for reorienting the $x_S$ axis of the sensor coordinate system 48. Accordingly, the transformation for transforming mount coordinates into this newly reoriented sensor coordinate system is given by a matrix, $C_{MS}$ which can be defined as:

$$\begin{bmatrix} \cos\delta_S\cos\alpha_S & \cos\delta_S\sin\alpha_S & -\sin\delta_S \\ -\sin\alpha_S & \cos\alpha_S & 0 \\ \sin\delta_S\cos\alpha_S & \sin\delta_S\sin\alpha_S & \cos\delta_S \end{bmatrix}$$

Since the matrix $C_{MS}$ is orthonormal, the mounting coordinates for the vector [1,0,0] in sensor coordinates is given by:

$$\begin{bmatrix} \cos\delta_S\cos\alpha_S \\ \cos\delta_S\sin\alpha_S \\ -\sin\delta_S \end{bmatrix} = C_{SM}{}^T \begin{bmatrix} 1 \\ 0 \\ 0 \end{bmatrix}$$

Additionally, note that given the above defined matrices and vectors, a composite transformation can now be defined between inertial coordinates and their corresponding sensor coordinates In particular, for a sensor 40 pointing vector ${}^I\hat{r}_{T/P}$ normalized in inertial coordinates, a corresponding pointing vector, ${}^I\hat{r}_{T/P}$ normalized in sensor coordinates can be provided as follows:

$${}^S\hat{r}_{T/P}=C_{SM}C_{MP}C_{PI}{}^I\hat{r}_{T/P}$$

Thus, by setting ${}^S\hat{r}_{T/P}$ to $[1,0,0]^T$ and applying the inverse of the matrix $C_{SM}$ (i.e.: $C_{SM}{}^T$) to both sides of the last equation, the following equation can be obtained:

$$\begin{bmatrix} \cos\delta_S\cos\alpha_S \\ \cos\delta_S\sin\alpha_S \\ -\sin\delta_S \end{bmatrix} = C_{MP}C_{PI}{}^I\hat{r}_{T/P}$$

Returning now to the flowchart of FIGS. 4A and 4B, in step 444 the sensor azimuth and elevation orientations $\alpha_S$ and $\delta_S$ are determined from this last equation. Note that the matrices and vector on the right hand side of the last equation can be fully evaluated using the inertial coordinates of the vector ${}^I\hat{r}_{T/P}$; the platform 20 latitude ($\lambda$) and longitude ($\eta$); the platform heading ($\psi$), roll ($\phi$) and pitch ($\theta$); ($\alpha_C$, $\delta_C$); and ($\alpha_{new}$, $\delta_{new}$). Thus, to direct the correct pointing of the sensor 40, the last equation can be solved for $\alpha_S$ and $\delta_S$ using inverse trigonometric functions as one skilled in the art will understand.

Subsequently, in step 448, the sensor 40 is moved according to the $\alpha_S$ and $\delta_S$ offsets. However, note that such offsets can be transformed into gimbal coordinates, as one skilled in the art will understand, for performing the movement of the sensor 40 to point in the desired direction.

The foregoing discussion of the invention has been presented for purposes of illustration and description. Further, the description is not intended to limit the invention to the form disclosed herein. Consequently, variations and modifications commensurate with the above teachings, within the skill and knowledge of the relevant art, are within the scope of the present invention. The embodiments described hereinabove are further intended to explain the best mode presently known of practicing the invention and to enable others skilled in the art to utilize the invention as such, or in other embodiments, and with the various modifications required by the particular application or uses of the invention. It is intended that the appended claims be construed to include alternative embodiments to the extent permitted by the prior art.

What is claimed is:

1. A method for orienting a sensor that is held to a movable platform using a mount, comprising:

obtaining mounting error compensating data for compensating for a misalignment between said platform and said mount, said mounting error compensating data being related to a difference between a platform coordinate system and a mounting coordinate system, said obtaining step including transforming said platform coordinate system into a sensor coordinate system assuming at least initially that said platform and said mount are aligned such that said platform coordinate system and said mounting coordinate system are identical and transforming said mounting coordinate system into said sensor coordinate system while making no assumption of alignment between said platform coordinate system and said mounting coordinate system;

ascertaining data related to a position of a reference target using at least a first coordinate system that is different from each of said platform coordinate system and said mounting coordinate system;

determining offset azimuth data and offset elevation data related to said mounting coordinate system using said mounting error compensating data and said data related to said position of the reference target; and positioning said sensor to encounter at least a second target of interest using said offset azimuth data and said offset elevation data.

2. A method, as claimed in claim 1, wherein:

said obtaining step includes scanning using said sensor at incrementally different positions thereof relative to the reference target.

3. A method, as claimed in claim 2, wherein:

said obtaining step includes executing a dithering program using a signal parameter obtained from said scanning step.

4. A method, as claimed in claim 2, wherein:

said obtaining step includes measuring signal strength received from the reference target at each said different position of said sensor.

5. A method, as claimed in claim 1, wherein:

said at least first coordinate system includes an inertial coordinate system having inertial coordinates associated therewith and said obtaining step includes:

ascertaining said inertial coordinates of the reference target;

providing inertial coordinates of said platform;

subtracting said inertial coordinates of said platform from said inertial coordinates of the reference target when deriving a corresponding difference vector; and transforming said difference vector into a said platform coordinate system.

6. A method, as claimed in claim 1, wherein:

said determining step includes using a matrix for transforming at least vectors represented in said platform coordinate system to vectors represented in said mounting coordinate system.

7. A method, as claimed in claim 6, wherein:

said obtaining step includes refining an approximate azimuth and elevation direction pair to determine said offset azimuth data and said offset elevation data.

8. A method, as claimed in claim 1, wherein:

said positioning step includes open loop pointing to move said sensor in which said sensor is moved based on said mounting error compensating data and said position of the second target of interest using said first coordinate system and, during said positioning step, use of closed loop control using feedback data from said sensor to move said sensor is avoided.

9. A method, as claimed in claim 1, wherein:

said positioning step produces alignment of said sensor with the second target of interest.

10. An apparatus for orienting a sensor, comprising:

a sensor positionable in a plurality of orientations;

a movable platform;

a mount joining said sensor to said platform;

first means for ascertaining mounting error compensating data, said mounting error compensating data related to a position of said mount relative to said platform, said first means ascertaining said mounting error compensating data using closed loop control to move said sensor in which said sensor is moved based on feedback obtained using predetermined movements of said sensor relative to at least one reference object; and second means for positioning said sensor in a desired orientation using open loop pointing in which said sensor is moved based on at least said mounting error compensating data and data related to a position of a target of interest that is determined based on a first coordinate system and in which use of closed loop control using feedback from said sensor to move said sensor is avoided.

11. An apparatus, as claimed in claim 10, wherein:

said platform is attached to an aircraft.

12. An apparatus, as claimed in claim 10, wherein:

said first means includes means for executing a scanning program involving a number of incremental positions of said sensor relative to the reference object based on said closed loop control.

13. An apparatus, as claimed in claim 12, wherein:

said first means includes means for executing a dithering program based on information from said scanning program.

14. An apparatus, as claimed in claim 13, wherein:

at least one of said scanning program and said dithering program utilizes a parameter related to a signal received by said sensor from the reference object.

15. An apparatus as claimed in claim 10, wherein:

said mounting error compensating data is used to determine offset elevation and azimuth data for positioning said sensor as desired.

16. an apparatus as claimed in claim 15, wherein:

said mounting error compensating data relates to a difference in orientation between a coordinate system for said platform and a coordinate system for said mount.

17. An apparatus, as claimed in claim 10, wherein:

said first means includes means for refining an approximate azimuth and elevation direction pair that initially assumes no error in alignment of said mount to said platform to determine said offset elevation and azimuth data.

18. An apparatus, as claimed in claim 10, wherein:

said first means has means for transforming vectors represented by coordinates in a platform coordinate system to vectors represented by coordinates in a mounting coordinate system.

* * * * *